United States Patent [19]

Caye

[11] 4,022,386

[45] May 10, 1977

[54] MATERIAL SPREADER FOR TRUCKS

[76] Inventor: Emery A. Caye, P.O. Box 148, Detroit Lakes, Minn. 56501

[22] Filed: Jan. 15, 1976

[21] Appl. No.: 649,461

[52] U.S. Cl. ..... 239/657

[51] Int. Cl.[2] ..... E01C 19/20

[58] Field of Search ..... 222/176, 178, 311, 312, 222/414, 318, 342, 415, 236, 254; 239/657, 664

[56] References Cited

UNITED STATES PATENTS

| | | | |
|---|---|---|---|
| 3,018,908 | 1/1962 | Wilton et al. | 239/657 X |
| 3,158,375 | 11/1964 | Vig | 239/657 |
| 3,189,355 | 6/1965 | Swenson et al. | 239/657 |
| 3,583,645 | 6/1971 | Murray et al. | 239/657 |

*Primary Examiner*—Stanley H. Tollberg
*Attorney, Agent, or Firm*—Williamson, Bains, Moore & Hansen

[57] ABSTRACT

A material spreader usable at the rear of dump trucks for distributing sand, salt, gravel, asphalt and the like, utilizes a dispensing means to drop material downwardly from the rear of the truck bin. A conveyor is positioned below the dispensing means and has a hopper to receive dropping material. The conveyor moves the material laterally to the right or left side of the truck. One or more flat, generally rectangular shields are swingably mounted to the hopper to swing between an operating position, wherein the shield overlies the hopper, intercepts falling material, and serves as a ramp in guiding it rearwardly and downwardly over the hopper to drop it behind the truck, and a storage position, wherein the shield is clear of the hopper so that material from the dispensing means moves freely into the hopper so as to be conveyed laterally by the conveyor. Latches are provided to retain the shields in storage and blocking positions. A splash panel is provided forwardly of the conveyor to intercept snow, mud, and the like which would otherwise be splashed into the conveyor by the moving truck.

12 Claims, 6 Drawing Figures

MATERIAL SPREADER FOR TRUCKS

BACKGROUND OF THE INVENTION

The invention relates to the field of material spreaders for trucks and provides an apparatus for selectively distributing sand, salt, gravel, asphalt or like material either rearwardly of a truck, laterally of the truck, or both, making it possible to simultaneously service or treat two or more lanes of a roadway with a single pass by the truck.

Dump trucks have long been used for the repair and maintenance of roads and highways. Typically, the trucks are used everywhere for carrying and dropping materials such as sand, gravel, and asphalt for the repair and maintenance of roads. In colder climates the trucks are used extensively to distribute salt, sand and other chemicals to alleviate otherwise slippery and hazardous road conditions. A variety of material spreaders has been conceived and used to distribute materials from the trucks. Typically, the spreader is mounted at the rear of the truck bin and pivots relative to the bin just as a standard dump truck tailgate would pivot. It usually includes equipment to break down clods of the material and also some dispensing means for dropping a measured amount of material directly rearwardly and downwardly from the truck and onto the roadway. Such spreaders are widely used and generally effective for distributing material directly rearwardly from the truck when only the lane immediately behind the truck is to be treated and is to receive material. Such spreaders are ineffective for distributing material laterally from the truck in order to treat a traffic lane adjacent to the lane in which the truck is traveling.

To meet the need to spread material laterally from the truck as well as rearwardly, trucks were provided with a spinning radial type spreader, and such spinners are effective to broadcast material in a 360° radius centered on the spinner. While the spinner is a useful device, it does have limitations. For example, the spinner discharges material in a 360° radius, and accordingly does not permit material to be directed to specific areas of the roadway. For example, if it is desired to sand, salt or otherwise treat the lane in which the truck is traveling and also the left, oncoming traffic lane while the truck travels in its regular right lane, the spinner would waste a substantial amount of material in that it would spread material over the two described lanes and also distribute it to the right of the truck and onto the right shoulder and roadside area where it is unneeded. In addition, the rapid rotational action of the spinner often discharges material at a relatively high velocity and can cause damage to adjacent vehicles.

In recent years conveyors have been mounted behind the dump truck to receive material dropped from the bin and to move the material laterally to right or left, permitting the material to be dispensed in the lane to the left of that in which the truck is traveling, or alternatively in the lane immediately to the right of the lane in which the truck is traveling. Such a conveyor also makes it possible for the truck to fill washouts or potholes in the road or adjacent the road by using the conveyor to move the material directly to the hole and drop it into the pothole or washout. However, mounting of the conveyor behind and below the truck bin resulted in all material from the bin being intercepted by the conveyor, and it was no longer possible to drop material directly rearwardly from the bin and onto the roadway or to sand or salt the roadway directly behind the truck without first going through the inconvenience of removing the conveyor from the truck. Accordingly, it would be advantageous to be able to utilize the desirable aspects of the basic dispensing means to thereby drop the material directly downwardly and rearwardly of the truck as well as simultaneously utilize the advantages of a conveyor system for laterally moving material to left or right of the truck. The present invention permits such a combination and allows simultaneous rearward or lateral dispensing of material from the truck.

Another problem encountered by known material spreaders utilizing conveyors is that ice, snow, mud, slush and the like are churned upwardly and rearwardly from the wheels of the truck and tend to reach the conveyor, sometimes reducing its efficiency. The present invention includes a splash panel structure which intercepts snow, ice, mud and the like and prevents its reaching the conveyor.

SUMMARY OF THE INVENTION

The invention comprises a material spreader for dump trucks for distributing sand, salt, gravel, asphalt and the like and is designed to permit material to be discharged directly rearwardly from the truck bin, or in a lateral direction to left or right of the truck, or simultaneously rearwardly and laterally of the truck. The invention can be used for original road construction, road repair, or for sanding or salting operations to alleviate slippery road conditions.

The material spreader is usable with a dump truck and includes a material moving apparatus attached to the bin of the truck in place of the standard tailgate. The material moving apparatus has a dispensing means which may utilize any device known to the art wherein the material from the bin is dispensed rearwardly from the bin in a controlled rearward or downward flow. The apparatus also includes a conveyor positioned below the dispensing means so as to receive material therefrom and to then move the material on a conveyor belt toward the left or right of the truck.

Means are provided to intercept the flow of material from the dispensing means to the conveyor, and to instead direct the material onto the roadway directly behind the truck. The interception means may be movably mounted to the conveyor and take the form of one or more rigid, flat, generally rectangular shields. Such a shield or shields may be angled rearwardly and downwardly to define ramp means for receiving and guiding intercepted material rearwardly over the conveyor to discharge the intercepted material rearwardly of the truck.

Preferably the shields are swingably mounted to the conveyor to move between an operating position overlying the conveyor, wherein the shields intercept material from the dispensing means, and a storage position clear of the conveyor, wherein the material from the dispensing means may be freely transmitted to and received by the conveyor.

A splash panel is interposed rearwardly of the truck wheels and forwardly of the conveyor and prevents mud, snow, slush and the like generated by movement of the truck wheels from reaching the conveyor.

Accordingly, by means of the material spreading invention a dump truck may include all the advantages of a standard rearward dispensing means and in addition all those of a lateral conveyor unit, the invention permitting material to be dispensed rearwardly, laterally or both simultaneously, thus permitting the simultaneous treating or servicing of more than a single traffic lane while still closely controlling the placement and distribution of dispensed material.

These and other advantages will be apparent from the appended drawings and the following detailed description.

DESCRIPTION OF THE PREFERRED EMBODIMENTS

Figure 1:
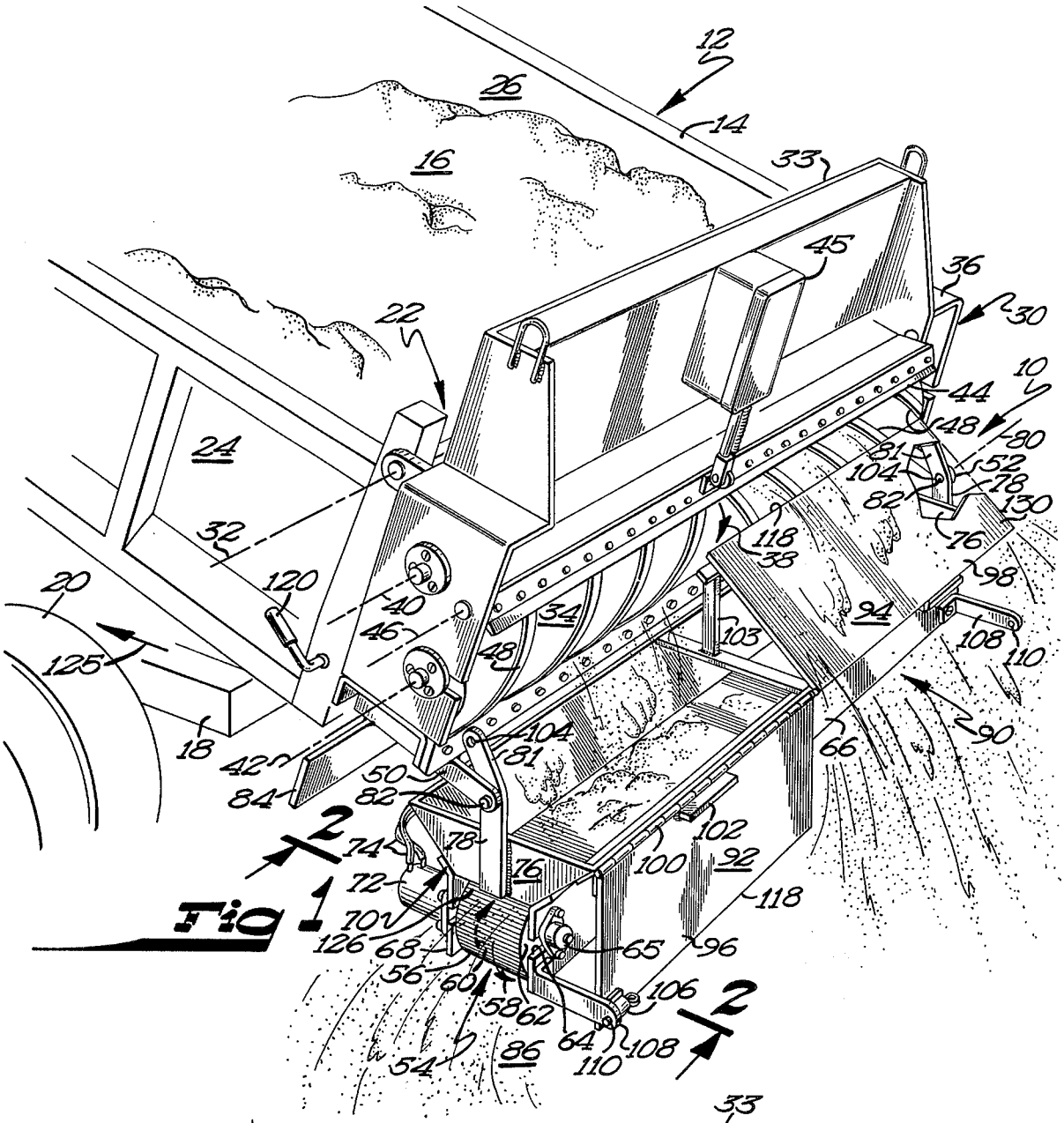
FIG. 1 is a partial rear perspective view of a dump truck having a material spreader embodying the invention.

Referring now to FIG. 1, a dump truck 12 has a material carrying bin 14 in which solid, spreadable material 16 such as sand, salt, gravel, asphalt or the like is contained and transported. The bin 14, which is carried on the chassis 18 of the truck and supported by wheels 20, has a rear end 22 whose lateral extremities are defined by side walls 24 and 26 which are interconnected by the bin floor 28.

Connected across the rear end of the bin and replacing the standard tailgate used with most dump trucks is a material spreader 10 embodying the invention. The material spreader 10 utilizes a dispensing means 30 which is pivotally mountd between the sidewalls 24 and 26 of the truck so as to swing about a generally horizontal axis 32 which is preferably the same axis about which a conventional tailgate would pivot if one were being used with the truck 12.

The dispensing means 30 is releasably locked in place at the rear 22 of the bin to define a barrier across the rear end so as to control the flow of the material 16 from the bin and dispense the material through the dispensing means. The dispensing means 30 includes a framework 33 and an elongated rotatably mounted dispensing drum 34 which is rotated about axis 42 by a gear system driven by a hydraulic or electric motor mounted in motor box 36, resulting in the drum 34 being selectively rotatable in direction 38 and remotely controllable by the driver of the truck. The drum may be provided with one or more sets of helical, raised ribs 48 to move and break up the material 16. Typically, an agitating roller having radially, outwardly extending cutter arms is positioned adjacent the dispensing drum 34 and is rotated about an axis 40 by the motor, the axis being generally parallel to and displaced from the axis 42 of the drum 34. The agitating roller breaks up clods of material within the bin and assures a reasonably smooth flow of material to the drum 34 which then carries the material rearwardly and downwardly in the general direction 38.

A gate 44 is pivotally mounted for movement about axis 46 and is swingable between an open position, wherein material 16 may be freely discharged under the gate 44 and over the rotating drum 34, and a closed position, wherein the gate 44 obstructs flow of any material past the drum 34. The position of the gate 44 is controlled from the cab of the truck 12 by hydraulic or electric actuator 45 so as to be selectively operable by the driver. The framework 33, drum 34, an agitating roller, the gate 44, motor 36 and actuator 45 collectively comprise one type of dispensing means usable with the invention to dispense material rearwardly from the bin.

While it is preferred to use a dispensing means such as the apparatus 30 which is shown in detail in U.S. Pat. No. 2,872,080, issued Feb. 3, 1959 to Anthony A. Thene and titled "Material Spreading Attachment for Truck," it should be understood that the shown dispensing means 30 described above may be replaced by any of a number of already available and known dispensing means so long as the means selected receives material from within the truck bin and dispenses it rearwardly of the truck in a controllable manner.

Rigidly fixed to the bottom of the framework 33 of the dispensing means 30 adjacent the lateral ends of the framework are substantially identical rearwardly extending support arms 50 and 52. Pivotally mounted between the arms to swing about an axis 80 is a conveyor 54. The conveyor 54 is hung from a pair of substantially identical upright stanchions 78 which are fixed to supports 76 and pivoted to arms 50 and 52. The conveyor 54 has a movably mounted conveyor belt 56 mounted for rotation in direction 58 or 60. The conveyor belt 56 is supported on two or more rotating rollers 62, a roller being positioned at each extreme end of the conveyor belt 56 and, if needed, one positioned intermediate therebetween. A slot 64 at one end of rear and front walls 66 and 68, respectively, of the conveyor 54 permits the bearing 65 of the drum 62 to be easily tightened in order to keep the belt 56 in a taut condition.

The conveyor 54 is provided with front and rear walls 68 and 66 and these walls may slope upwardly and to front and rear, respectively, to define an integral hopper 70 overlying the conveyor belt 56 and positioned below the dispensing drum 34 so as to receive material 16 from the drum and direct it downwardly onto the conveyor belt 56.

A hydraulic motor 72 is mechanically coupled with the nearest drum 62 to rotate the drum and thereby move the conveyor belt 56 in direction 58 or 60. Fluid is transmitted to and from the motor 72 through hydraulic lines 74.

The conveyor which preferably includes the shown integral hopper 70 is pivotally mounted to the arms 50 and 52 so that the conveyor may pivot about the axis 80 so as to be self leveling, retaining the upper surface of the belt 56 in a generally horizontal position even when the truck bin 14 is raised to an inclined dumping position. The stanchions 78 may be pivotally mounted to the arms 50 and 52 by the shown pivot pins 82 or by any other pivot or hinge means known to the art.

The conveyor 54 and its hopper 70 are thus swingably mounted to the arms 50 and 52 with the forward edge of the hopper 70 extending below and forwardly of the rotatable dispensing drum 34 and positioned rearwardly of a splash panel 84 (FIGS. 1 and 2) which is fixed to the bottom of the framework 33 and extends generally parallel to the axis 42 of the drum, serving the purpose of intercepting snow, ice, mud, slush and the like which would otherwise be sprayed rearwardly from the wheels 20 and into the hopper 70.

The already described dispensing means 30 or an equivalent thereto and also the described conveyor 54 collectively comprise a material moving apparatus 90 which is attachable to the truck 12 and mountable as described adjacent the rear of the bin 14 for receiving material 16 from the bin and discharging it at the rear of the truck, the dispensing means dropping the material rearwardly downwardly off the drum or roller 34 and the conveyor 54 moving the material laterally relative to the truck to discharge the material laterally onto a roadway 86.

Swingably mounted to the material moving apparatus 90 is a pair of shields 92 and 94, the shields preferably being mounted to the rearward wall 66 of the hopper 70. Each of the shields 92 and 94 is formed of a rigid, flat, smooth, generally rectangular metal plate and is mounted for movement between a storage position 96 and an operating position 98.

While the shield is in storage position 96, it remains clear of the hopper 70 so that material dispensed from the drum 34 may fall freely into the hopper. While the preferred storage position 96 is as shown in FIGS. 1 and 2 wherein the plate is swung to a downward pendant position 96 rearward of the hopper, it should be understood that other storage positions wherein the plates 92 or 94 do not interfere with the flow of material from the roller 34 to the hopper 70 are contemplated and within the scope of the invention.

When the shields are in operating positions 98 they overlie hopper 70 and conveyor 54 so as to provide an interception means adapted to intercept material 16 released from the dispensing means 30 and to direct the intercepted material 16 downwardly onto the roadway 86. Preferably the shields, when in operating position, are angled downwardly and rearwardly from the dispensing means 30 to serve as a ramp means so as to receive and guide intercepted material 16 downwardly and rearwardly over the conveyor 54 and to discharge the intercepted material rearwardly of the conveyor.

Figure 2:
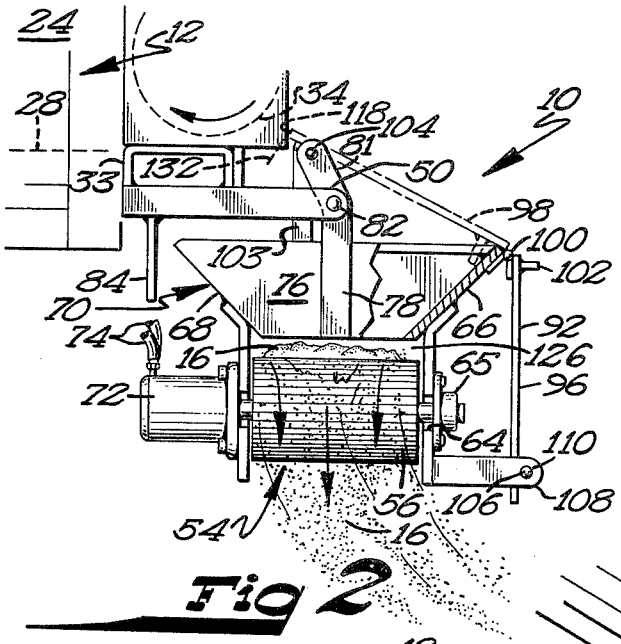
FIG. 2 is a side elevation view of the material spreader of FIG. 1 taken in the direction of arrows 2—2 of FIG. 1.

Each of the shields 92 and 94, which are substantially identical to one another, is shown as includng a hinge 100 joining it to the rear wall 66 of hopper 70 and each shield has an outwardly extending stop member 102 which bears against the interior side of rear wall 66 when the shield is in operating position 98, as best shown in FIG. 2. The stops 102 provide support for the shields when in operating position 98 and cooperate with a first latch on each shield, to be described hereafter, to retain the shield in operating position and at a spaced interval from the drum 34 adapted to permit free rotation of the drum unimpeded by the adjacent shield yet to receive and direct material 16 which falls from the roller and onto the shield.

Referring again to FIGS. 1 and 2, a generally upwardly and forwardly extending extension 81 of each stanchion 78 has an aperture 104 therethrough. Each of the shields 92 and 94 is provided with a spring-loaded latch pin 106 which is normally biased to inject its pin through aperture 104 when the shield 92 or 94 is in operating position 98. Accordingly, the extension 81 and the spring-loaded latch pin 106 cooperate to define a first latch means by which the shield 92 or 94 is retained in operating position. It should be further noted that the described first latch means cooperates with stop 102 and also with a median shield support post 103 to retain the shields in operating positions 98.

Keeper bars 108 are fixed to the rear wall 66 of hopper 70 at opposite ends of the wall and extend rearwardly therefrom. Each of the bars 108 has an aperture 110 therethrough, the bars and apertures being positioned so as to align with the spring-loaded latch pin 106 of shields 92 and 94 when they are in storage position 96. Accordingly, the keeper bars 108 cooperate with the latch pins 106 to define a second latch means for retaining the shields in storage position 96, thereby preventing their swinging about during travel of the truck.

Figure 4:
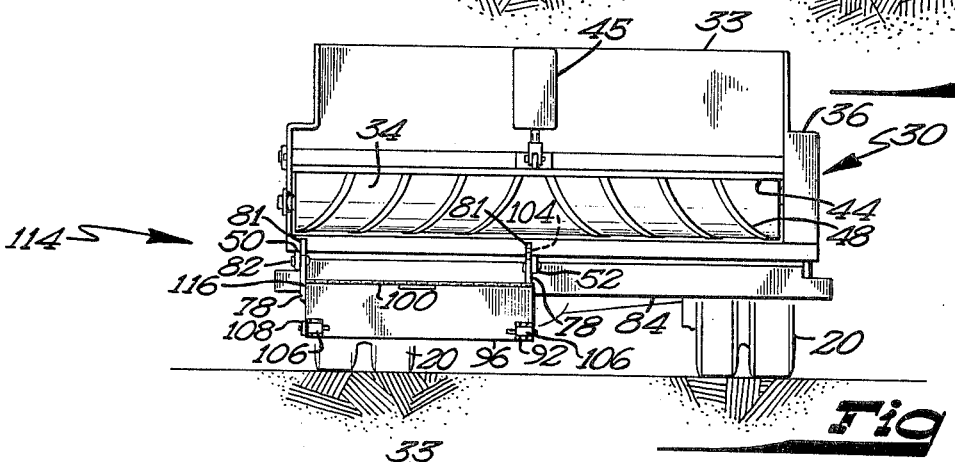
FIG. 4 is a rear view of a truck utilizing the invention wherein the conveyor extends approximately halfway across the rear of the truck bin.

Referring now to FIG. 4, a second embodiment 114 of the material spreader invention is shown. The embodiment 114 is substantially identical to embodiment 10 except that the conveyor 116 of embodiment 114 extends approximately half way across the rear of the truck, and accordingly has a length less than that of the dispensing means 30 and of drum 34. Embodiment 114 is provided with a single shield 92, like that already described, which is swingably mounted and operates identically to the shield 92 described in conjunction with embodiment 10, but overlies the entire conveyor 116 when in operating position 98.

In operation, the bin 14 of the truck is filled with appropriate material 16 to be dispensed and on reaching the area at which the material is to be spread, the driver actuates the dispensing means 30 by opening gate 44 and starting motor 36, causing the dispensing drum 34 to begin rotation in direction 38 and the agitator roller to begin rotating to break up clumps of the material. Accordingly, the material 16 is dispensed rearwardly over and by the drum 34 and dropped downwardly therefrom. So long as gate 44 remains in an open position the material 16 continues to be dispensed rearwardly over the roller 34.

If it is desired that all of the material dispensed from the drum 34 is to be moved laterally to the left or right relative to the direction of truck travel, the shields 92 and 94 are placed in storage positions 96 and the spring-loaded latch pins 106 are engaged with the apertures 110 of the keeper bars 108 to thereby confine the shields in storage positions 96 and prevent their swinging or rattling at the rear of the truck. With the shields in storage positions 96, substantially all material 16 dispensed from the drum 34 will be delivered to the hopper 70 and directed onto conveyor belt 56. When the conveyor belt is rotated in direction 56 by hydraulic motor 72, the material will be dispensed laterally toward the left of the truck as it travels in the forward direction 125. Alternatively, when the conveyor belt is operated in direction 60 the material 16 will be moved laterally to the right side of the truck and dispensed into the traffic lane to the right of the truck.

By varying the speed of the hydraulic motor 72, the material can be dropped either immediately adjacent or thrown a substantial distance from the truck to thereby spread it across the traffic lane or lanes adjacent that in which the truck is traveling. In the event that potholes or washouts must be filled, the truck can stop with either of the conveyor discharge openings 126 immediately above the washout or pothole, and while the truck is stationary material can be dispensed from the drum 34 and conveyed by the conveyor belt 56 to a location directly over the pothole or washout and such hole or washout filled with the material 16.

From the foregoing description it will be recognized that the shields 92 and 94, when in storage positions, do not interfere with the operation of the dispensing means 30 or the conveyor 54, and accordingly permit all material 16 dispensed from the rear of the truck to be moved laterally to the left or right to meet specific construction or maintenance requirements.

If it is desired to dispense all of the material rearwardly behind the truck so as to sand or salt or otherwise treat the traffic lane in which the truck is traveling, the operator releases the spring-loaded latch pins 106 from the apertures 110, freeing shields 92 and 94. He then swings the shields from storage positions 96 to the operating positions 98 (FIG. 6) and then engages the latch pins 106 in the apertures 104 of upright extensions 81. In the operating position 98, the shields are supported and retained in the operating positions by cooperation between the latch pins 106, the extensions 81, the outwardly extending stop 102 which bears against the rear wall 66 of the hopper 70 and support post 103.

Figure 6:
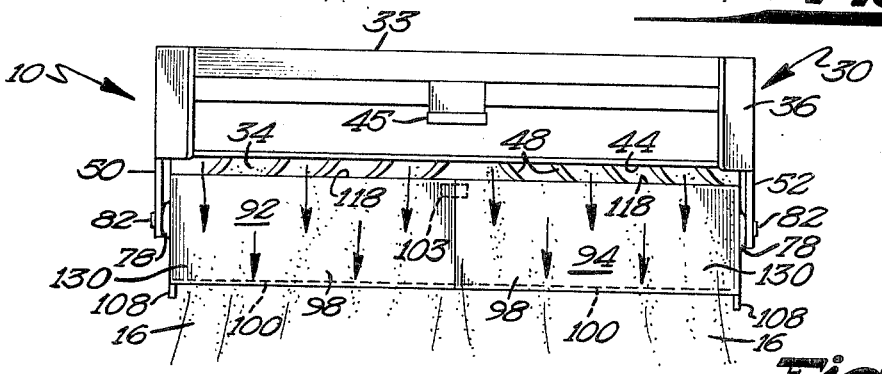
FIG. 6 is a top elevation view of the rear of a truck wherein the shields are in operating position so as to discharge all material rearwardly from the truck.

In the operating positions 98 the leading edge 118 of each shield is positioned closely adjacent the rotating drum 34 but is spaced from it sufficiently to permit free rotation of the drum while intercepting and receiving substantially all material 16 being dispensed over the top of the drum 34. Material from drum 34 is received on the upper surface 130 of shields 92 and 94 and is directed rearwardly, downwardly therealong, causing the material to drop behind the conveyor 54 or 116 and into the traffic lane in which the truck is traveling to effectively treat the roadway with material 16, as best seen in FIG. 6.

Figure 5:
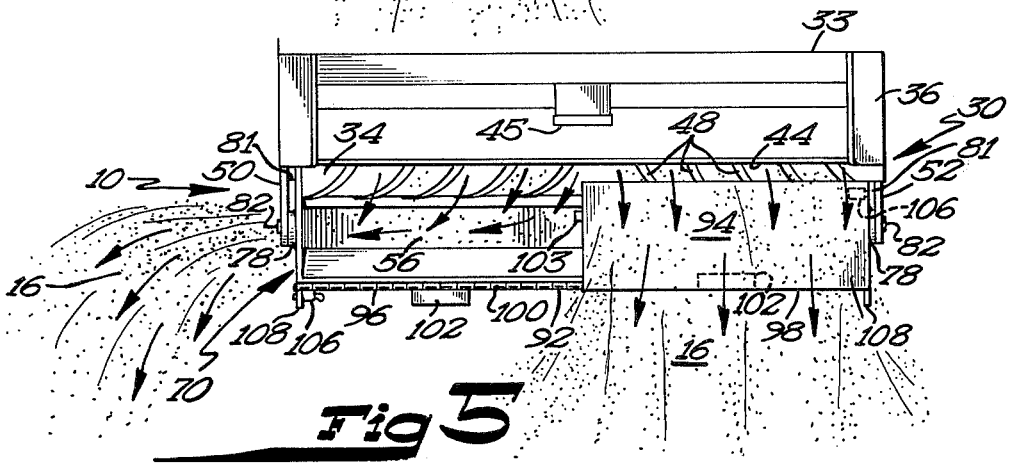
FIG. 5 is a top elevation view of the material spreader at the rear of a truck, showing the invention in operation, and wherein one shield is in operating position and the other in storage position.

When it is desired to dispense material both rearwardly into the traffic lane in which the truck is traveling and also into the lane adjacent the truck, as for example the lane to the left of the truck, the shield 94 farthest from the left lane is placed in operating position 98 and the nearer shield 92 in storage position 96. Referring now to FIG. 5, the shield 92 is secured in storage position 96, in which position the latch 106 engages keeper bar 108 to firmly retain the shield 92 in the shown position in which it is restrained and clear of the hopper 70.

Shield 94 is locked in operating position 98 by engaging its latch pin 106 in aperture 104 to retain it in position 98. In operating position 98 the shield 94 is retained by cooperation between latch pin 106 engaging extension 81, stop 102 which bears against the rear wall 66 of the hopper, and upright support post 103.

Accordingly, when material is dispensed rearwardly and downwardly over the drum 34, material 16 landing on the shield 94, which is angled downwardly and rearwardly, is directed along the ramplike shield and dropped rearwardly behind the truck, to distribute the material 16 in the lane in which the truck is traveling.

Material dispensed from the drum 34 along the left most half of the drum drops directly downward into the hopper 70 and is received on the conveyor belt 56. To treat the traffic lane immediately to the left of that in which the truck is traveling, the conveyor belt 56 rotates in direction 58 and its hydraulic motor 72 provides sufficient velocity to carry the material 16 to the left of the truck and throw it off the end of the conveyor belt and into the adjacent traffic lane, thereby treating the adjacent lane with sand, salt, or other desired material. Accordingly, the material spreader permits two or more traffic lanes to be treated with material and the distribution of material carefully and selectively controlled by a truck traveling in a single lane. It should be noted that as the truck bin is elevated to move material 16 rearwardly, the conveyor 54 or 116 is self leveling and pivots about axis 80 to remain in a generally horizontal orientation. As the bin rises, the leading edges 118 move along path 132, slipping below and forwardly, relative to the drum 34, as best appreciated from FIG. 2. The path 132 along which edge 118 moves does not contact drum 34 and permits unimpeded operation of the dispensing means 30.

If desired, the truck may utilize the material spreader to distribute material to its own traffic lane and to the lane immediately to the right of the truck by placing the shield 92 in operating position 98 and the shield 94 in storage position 96 and reversing the direction of the conveyor belt to move in direction 60.

Figure 3:
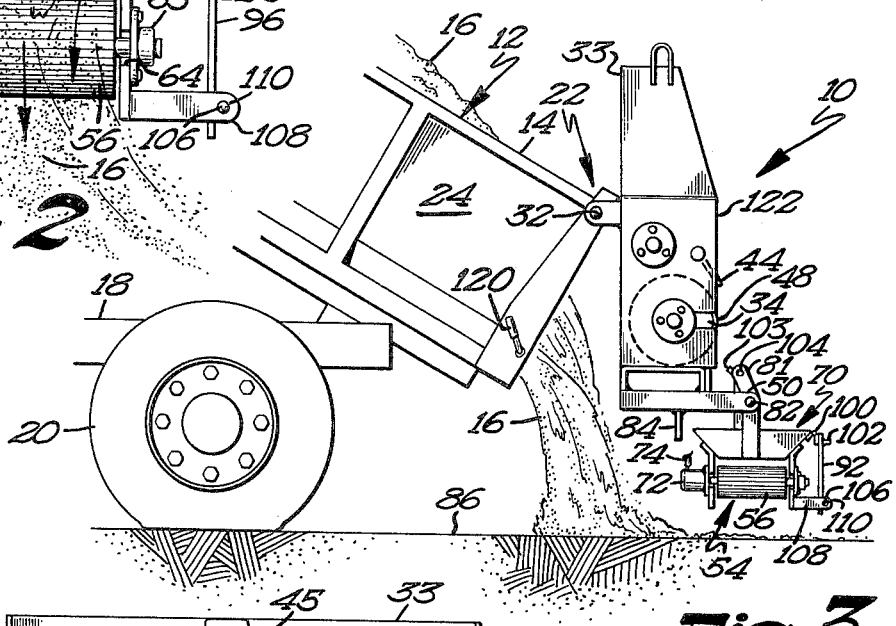
FIG. 3 is a partial side elevation view of the rear of a dump truck showing the material spreader in a position clear of the bin to permit material to be discharged from the bin without using the spreader.

If it is desired to discharge all of the material from the truck bin at a single location by dumping it from the rear of the truck as would normally be done without a material spreader at the rear, this can be easily accomplished by raising the bin and releasing discharge lever 120 (FIGS. 1 and 3). The material spreader then swings downwardly, rearwardly as would a standard tailgate to position 122, permitting the material 16 to be dumped without interference by or to the material spreader.

Referring now to FIG. 4 which shows the material spreader 114 having a conveyor extending approximately half the length of the dispensing means, the operation of the embodiment 114 is substantially identical to the operation of embodiment 10 already described, except that all material dispensed from drum 34 along the right half of the drum falls generally rearwardly and downwardly onto the roadway and does not interact with the conveyor 116. The material dispensed from the left half of the drum 34 of FIG. 4 drops into conveyor 116 when the shield 92 is in storage position 96, resulting in the material being moved along the conveyor toward the left of the truck as the truck moves in a forward direction. Accordingly, the material reaching the conveyor 116 is dispensed to the traffic lane located to the left of the truck and thus embodiment 114 results in the treating both of the traffic lane in which the truck is traveling and of the lane adjacent to and leftward of the truck. When shield 92 of the embodiment 114 is swung to operating position 98, the material dispensed from the left half of drum 34 is intercepted by shield 92 and directed downwardly and rearwardly of the conveyor so that all material 16 dispensed from the drum 34 is discharged rearwardly of the truck and onto the traffic lane in which the truck is traveling. The operation of conveyor 116 is substantially identical to that of conveyor 54 already described, except that no upright support post 103 is needed and instead an upright forwardly extending extension 81 is provided at the right end of the shown conveyor 114 and extending upwardly from the stanchion 78. A second spring-loaded latch pin 106 is provided at the right side of shield 92 to engage an aperture 104 in extension 81 at the right end of the conveyor. While conveyor 116 has been shown as being positioned below the left half of dispensing drum 34, it should be understood that, if desired, conveyor 116 may as readily be positioned below the right half of the drum 34, and such positioning is within the purview of the invention.

While the preferred embodiments of the present invention have been described, it should be understood that various changes, adaptations and modifications may be made therein without departing from the spirit of the invention and the scope of the appended claims.

What is claimed is:

1. A material spreader usable with a dump truck having a material carrying bin with a pair of lateral sidewalls to dispense material from the bin and onto a roadway, comprising:

a material moving apparatus attachable to the truck and mountable adjacent the rear of the bin, said apparatus including dispensing means positionable to receive material from the bin and to release the material in a rearward and downward direction to define a flow of material extending substantially between the lateral sidewalls of the bin, and further including an open-ended conveyor positioned below said dispensing means to receive material from said dispensing means and capable of moving material received from said dispensing means laterally relative to the truck and discharging the material laterally from the open-ended conveyor and onto the roadway; and ramp means movably mounted to said material moving apparatus and movable between a storage position permitting unobstructed flow of material from said dispensing means to said conveyor, and an operating position overlying said conveyor, wherein said ramp means intercepts material released from said dispensing means, said ramp means when in operating position being angled transversely to said rearward and downward direction of flow rearwardly and downwardly from said dispensing means to rearwardly deflect and distribute the material.

2. The material spreader of claim 1 wherein said ramp means is swingably mounted to said material moving apparatus to swing between said storage and said operating positions.

3. The material spreader of claim 1 wherein said ramp means is swingably mounted to said conveyor to swing between said storage and operating positions.

4. The material spreader of claim 1 wherein said ramp means includes a plurality of rigid, flat, generally rectangular shields.

5. The material spreader of claim 1 wherein said dispensing means includes a framework attachable to said bin and an elongated dispensing drum rotatably mounted to said framework and extending transversely across the rear of the truck to dispense the material in said downward rearward direction toward said ramp means.

6. The material spreader of claim 5 wherein said conveyor includes a hopper positioned to receive material from said dispensing drum and wherein said ramp means in swingably mounted to said hopper to swing between said operating and storage positions.

7. The material spreader of claim 6 wherein said material moving apparatus includes an elongated splash panel positioned forwardly of and generally parallel to said hopper and below said dispensing means to block unwanted snow, water and mud which would otherwise splash into said hopper during movement of the truck.

8. The material spreader of claim 1 wherein said ramp means is swingably mounted to said conveyor and said conveyor is pivotally mounted to said dispensing means so as to be self leveling when the bin of the truck is elevated, and said ramp means having a leading edge spaced closely adjacent said dispensing means and movable along a path as said conveyor pivots during self leveling, said path being clear of said dispensing means so as to permit unimpeded operation of said dispensing means while said ramp means is in operating position to intercept material released from said dispensing means.

9. The material spreader of claim 8 wherein said ramp means is carried pendently downwardly from said conveyor when in storage position.

10. The material spreader of claim 8 wherein said conveyor includes an endless conveyor surface and wherein said ramp means includes a generally flat surface oriented transversely relative to said conveyor surface when in said operating position.

11. In combination with a dump truck having a material carrying bin, a material spreader usable to dispense the material from the bin and onto a roadway, comprising:

dispensing means attached to the rear of said bin and including a rotatable dispensing drum, said dispensing drum receiving the material from within the bin and discharging the material rearwardly and downwardly from said drum all along the rear of said bin;

an open-ended conveyor having a hopper positioned below said dispensing means to receive material from said dispensing drum, said conveyor arranged to move the material laterally relative to said truck and discharge the material laterally from said open-ended conveyor; and interception means pivotally mounted to said conveyor and extending substantially all along said drum, said interception means movable between a storage position permitting free flow of material from said drum to said conveyor hopper and an operating position overlying said hopper and below and rearwardly of said drum to intercept material released from said dispensing drum and prevent such material reaching said hopper, said interception means being angled rearwardly and downwardly from said dispensing means and over said hopper to receive and guide material rearwardly over said hopper and dispense a flow of the material rearwardly of said conveyor and all along the said interception means.

12. A material spreader usable with a dump truck having a material carrying bin to dispense the material from the bin and onto a roadway, comprising:

a material moving apparatus attachable to the truck and mountable adjacent the rear of the bin, said apparatus including dispensing means positionable to receive material from the bin and to release the material from the bin, and further including a conveyor positioned adjacent said dispensing means to receive material from said dispensing means and capable of moving the material laterally relative to the truck and discharging the material laterally onto the roadway; and interception means movably mounted to said material moving apparatus and movable between a storage position wherein said interception means extends pendently downward from said apparatus permitting material from said dispensing means to be freely transmitted to said conveyor, and an operating position between said conveyor and said dispensing means, wherein said interception means is oriented transverse to the direction of flow of material from said dispensing means to said conveyor to intercept material released from said dispensing means and deflect the intercepted material away from said conveyor and rearwardly onto the roadway.

* * * * *